United States Patent [19]

Geisel et al.

[11] 4,425,985

[45] Jan. 17, 1984

[54] LADDER PLATFORM

[76] Inventors: Anthony Geisel, 109 S. Busse Rd.; Bohdan Rohowsky, 402 S. Main, both of Mt. Prospect, Ill. 60056

[21] Appl. No.: 349,047

[22] Filed: Feb. 16, 1982

[51] Int. Cl.[3] ..... E06C 5/32; E06C 7/14

[52] U.S. Cl. ..... 182/121; 182/129

[58] Field of Search ..... 182/120, 121, 122, 129; 248/238, 210

[56] References Cited

U.S. PATENT DOCUMENTS

| | | | |
|---|---|---|---|
| 2,415,289 | 2/1947 | Jury | 182/121 |
| 3,331,577 | 7/1967 | Grunwaldt | 182/121 |
| 3,899,045 | 8/1975 | Geisel | 182/121 |
| 4,261,435 | 4/1981 | Winter | 182/121 |

*Primary Examiner*—Reinaldo P. Machado

*Attorney, Agent, or Firm*—Kinzer, Plyer, Dorn & McEachran

[57] ABSTRACT

A platform device having utility as a ladder platform includes a frame comprising support members, two on each side, with the support members on each side being joined adjacent their upper ends and spread apart at their lower ends. There are means joining the corresponding upper and lower ends of the support members on one side with the support members on the other side. One of the support members on each side has a curved portion at the upper end thereof, which portion is formed and adapted to rest upon the rung of a ladder. The means joining the lower ends of the support members includes a lower platform which is formed and adapted to rest upon a lower adjacent ladder rung. There is a hook member pivotally attached at opposite ends thereof to the distal ends of said curved portions with the hook member being formed and adapted to be self-locking upon the upper rung.

11 Claims, 3 Drawing Figures

LADDER PLATFORM

SUMMARY OF THE INVENTION

The present invention relates to a platform device having utility as a work station on a ladder and in particular to such a device which has a pivotal hook at the top thereof which functions both as a means for carrying the platform device and as a self-locking restraint preventing a person upon the platform from accidentally pulling it off.

Another purpose is a platform device of the type described which has means of adjustment to accomodate different ladder rungs.

Another purpose is a platform device of the type described in which the hook element has means thereon insuring its return to a locking position.

Another purpose is a ladder platform having a lower platform and an upper tool tray or utility box.

Another purpose is a platform device of the type described in which the spacing between upper and lower portions thereof is such that the platform will be snugly fit upon a ladder.

Another purpose is a simply constructed reliably operable platform device of the type described.

Another purpose is a platform device which has utility with a ladder and which also can function as a tool carrier and a tool holder, even when not positioned upon a ladder.

Another purpose is a platform device of the type described in which the hook member is self-locking.

Another purpose is a platform device of the type described including means for accomodating ladder rungs of different sizes and shapes.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 2, 3:
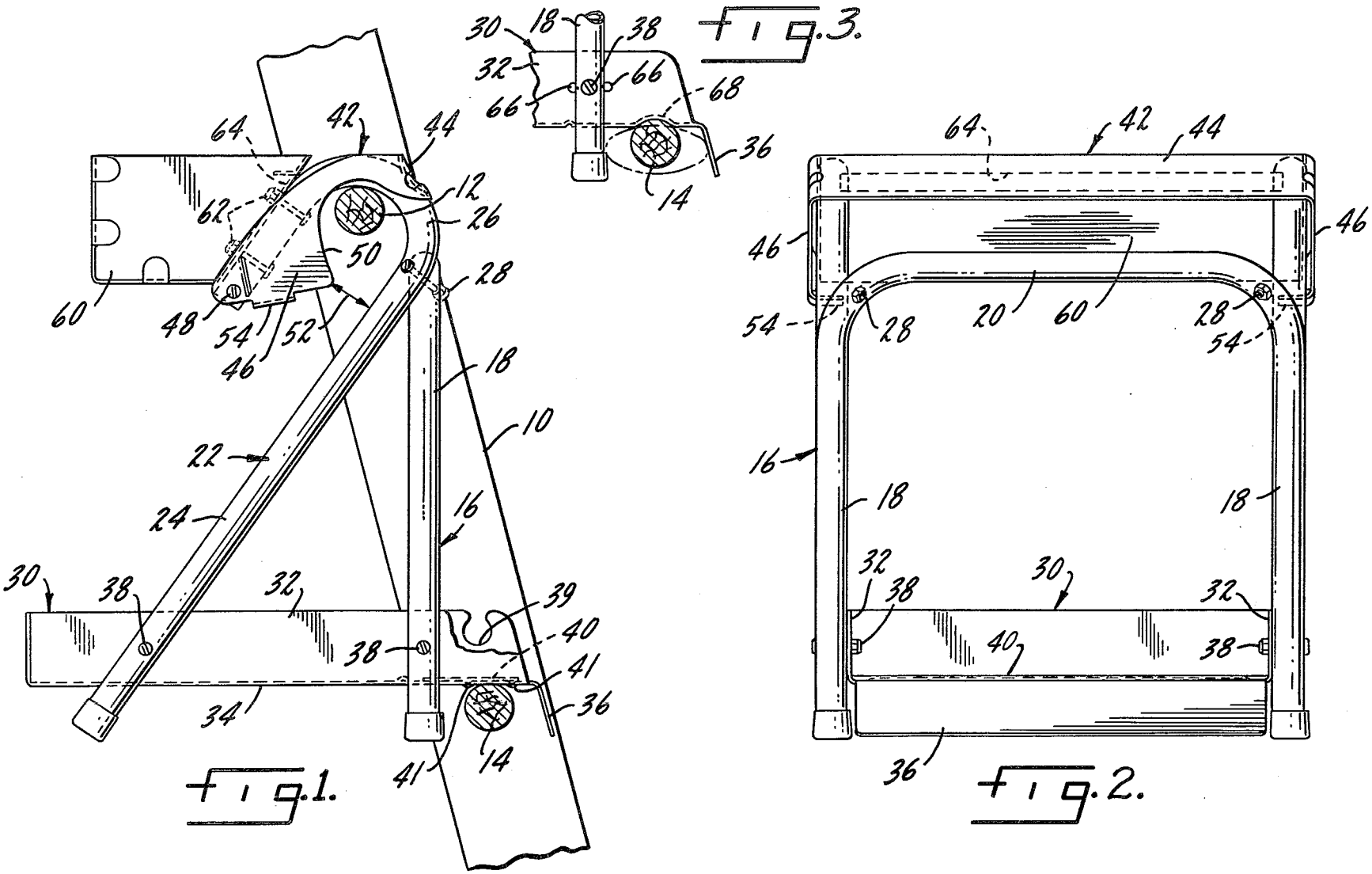
FIG. 1 is a side view of the platform device of the present invention, illustrated in position on a ladder.
FIG. 2 is a front view of the platform device of FIG. 1.
FIG. 3 is a partial side view of a modified form of platform device.

Although the present invention will be essentially described as a platform device for use on a ladder, it should be understood that it also has utility as a tool carrier or tool caddy and as a platform to hold tools, paint and other implements when positioned on a flat surface such as a floor. The invention, although highly usable with a ladder, should not be so limited.

In FIG. 1 a typical ladder is shown at 10 and is illustrated in the conventional slanted position that the ladder would assume when positioned upon a supporting wall. Spaced rungs 12 and 14 are used to support the platform device.

The platform device includes a frame which may consist of a U-shaped member 16 having legs 18 and a connecting bar 20. Member 16 is shown to be of tubular construction, but could be otherwise. The entire frame could be made of any suitable material of tubular form, as shown, or it could be formed of flat independent members suitably bolted or welded together or it could be formed or molded in one piece. At each side of the platform device there are cane-shaped members 22 which each have a leg 24 and a curved portion 26. The cane-shaped members 22 form a part of the frame and are each suitably bolted to the U-shaped member 16, as at 28. The cane-shaped members 22 may be tubular as shown or they may be otherwise, as described above.

Positioned adjacent the lower portion of the platform device is a lower platform 30 having side walls 32, a bottom 34 and a downwardly extending front lip 36. Platform 30 may be connected by bolts or the like 38 to the four legs which form the frame, thus forming a means to separate the lower portion of the frame legs, provide a means for physically connecting opposite sides of the frame as well as those legs forming the frame sides. One or all of the side walls 32 of platform 30 may have a small opening 39 or suitable hooks for use in anchoring a power cord or the like.

Bottom 34 of lower platform 30 may have an area 40 covered by a non-skid type of material to enhance foot grip for someone standing on the platform. The bottom surface of bottom 34 may have two rows of laterally extending and downwardly protruding ribs 41, particularly illustrated in FIG. 1, which are spaced apart a distance generally less than, for example one-half the diameter of a conventional ladder rung, as illustrated at 14. Thus, the lower portion of the platform device will be anchored upon lower ladder rung 14 by means of elements 18 and 36 and assisted by projections 41.

The upper ends of the cane-shaped members 22, as described above, are connected to frame member 16 and are also connected to each other by a hook member 42. The hook member consists of a generally central grab bar 44 which may be integral with hook elements 46, one on each side, each of which is pivoted to a distal end of curved portion 26 of a cane member 22. The pivotal connection is illustrated at 48 in FIG. 1. Thus, the hook member serves to connect the upper end of members 22 together and, in addition, functions as a means for transporting or carrying the platform device as it is pivotally connected to the frame.

Each of hook elements 46 has an inner curved surface 50, particularly illustrated in FIG. 1, which curved surfaces are similar but not the same as the curved surfaces on portions 26 of members 22. Of importance is the fact that when the platform device is in the mounted position of FIG. 1, the space 52 between a leg 24 of member 22 and the closest portion of a hook element 46 is less than the diameter of a typical ladder rung, such as rung 12. Thus, if someone grabs bar 47 to steady himself upon the platform or to keep from falling off the platform, it will be impossible to remove the platform by a force applied generally horizontally as the space through which the rung would have to pass is less than the diameter of the rung. Also, such a generally horizontally applied force would tend to insure that the hook stays firm in position. The hooks are released by a generally upward or vertical pivotal movement which is used in removing the platform device from the ladder. A horizontal force of the type described is self-locking or self-tightening.

Also of importance is the fact that curve 50 as well as the curves on the inside of curved surface 26 of members 22 are so arranged and formed that round ladder rungs as well as oval, square or ladder rungs of other construction configurations can be easily accomodated.

There is a further locking or self-tightening feature of the platform device which is important. The distance between pivot point 48 and bottom ladder rung 14 is less than the distance from the bottom rung to any point along the curvature of the hook. Thus, if someone were to stand upon the lower platform 30 outside of rung 14, such a pivotal force or tendency to pivotally move would be resisted and the curved surface 50 of the hooks would quickly contact upper rung 12, reducing any pivotal movement of the platform device. Thus, the platform is secure and stable and provides a self-locking or self-tightening construction.

There are inwardly extending tabs 54 on the lower portion of each hook element 46, which tabs are particularly illustrated in FIG. 2. These tabs insure that the hook element which is in effect a handle will always return to the position of FIG. 1. When the handle is used as a means to transport the device, the tabs will bear against the inner surface of curved portion 26 of elements 22 permitting the handle to be in a somewhat upright position. However, as soon as the handle is released, the hook member will immediately return to its at rest position.

A tray 60 maybe attached, by bolts or the like 62, to the end of crane elements 22. The tray may function as a tool holder; if it is made of plastic or is water-tight it may function as a paint tray to be used with a paint brush or roller. There is a slot 64 at one side of the tray which may be used to insert a water-tight inner tray for painting purposes.

An alternate frame construction is illustrated in FIG. 3. In this case there are spaced connecting holes 66 used to fasten the lower end of legs 18 to the side walls of lower platform 30. Such an arrangement is advantageous in that it insures that the platform will always be level. Also, the variation in hole position can be used to accomodate different size and shaped ladder rungs as it is important that the rung fit snugly between downwardly extending lip 36 of the platform and the adjacent legs 18. Also, in the construction of FIG. 3 the downwardly extending projections 40 of the FIG. 1 construction have been replaced by a laterally extending arcuate recess 68. Recess 68 is formed and adapted to accomodate a round ladder rung as particularly illustrated in FIG. 3. Also, the space between lip 36 and leg 18 will accomodate an oval leg, as illustrated in broken lines in FIG. 3.

Regardless of the construction of the ladder rung, e.g. whether it be round or oval, the platform device and the curvatures of curved surfaces 26 are so arranged that there is the same spacing between ladder rungs. Accordingly, the platform will be firmly and stably fitted upon the ladder regardless of the shape of the rungs on the ladder.

Although not shown herein, the bottom 34 of lower platform 30 may have various raised areas or depressions or the like to hold certain designated objects such as paint cans or the like.

Whereas the preferred form of the invention has been shown and described herein, it should be realized that there may be many modifications, substitutions and alterations thereto.

The embodiments of the invention in which an exclusive property or privilege is claimed are defined as follows:

1. A platform device which has utility as a ladder platform including a frame, said frame comprising support members, two on each side, with the support members on each side being joined adjacent their upper ends and spread apart at their lower ends, means joining the corresponding upper and lower ends of the support members of one side with the support members of the other side, one of the support members on each side having a curved portion at the upper end thereof, said curved portion being formed and adapted to rest upon the rung of a ladder, with the means joining the lower ends of said support members being formed and adapted to rest upon a lower adjacent ladder rung, and a hook member pivotally attached at opposite sides thereof to the distal ends of said curved portions, said hook member being formed and adapted to be self-locking upon the upper rung and comprising a pair of spaced hook elements, each pivoted to the distal end of one of said curved portions, and a grab bar connecting said hook elements.

2. The platform device of claim 1 further characterized in that the spacing between the ends of the hook elements and an adjacent portion of the support member curved portion, when positioned on a ladder, is less than the width of a ladder rung.

3. The platform device of claim 1 further characterized by and including an inwardly extending tab on each hook element adjacent but spaced from the pivotal connection thereof, said tabs restricting the pivotal movement of said hook member and permitting the grab bar connecting the hook elements to function as a carrying device.

4. The platform device of claim 3 further characterized in that said tabs are so positioned relative to the pivotal connection of said hook elements and the curved portion of said support members that release of the grab bar causes said hook member to always return to a rung locking position.

5. The platform device of claim 1 further characterized by and including a tray mounted upon said curved portions adjacent the upper end thereof.

6. A platform device which has utility as a ladder platform including a frame, said frame comprising support members, two on each side, with the support members on each side being joined adjacent their upper ends and spread apart at their lower ends, means joining the corresponding upper and lower ends of the support members of one side with the support members of the other side, one of the support members on each side having a curved portion at the upper end thereof, said curved portion being formed and adapted to rest upon the rung of a ladder, with the means joining the lower ends of said support members being formed and adapted to rest upon a lower adjacent ladder rung, the lower ends of said support members being connected together by a lower platform mounted to each of said support members adjacent the lower ends thereof, the attachment of said lower platform to one of said support members, at each side thereof, being adjustable to accomodate different ladder rungs.

7. The platform device of claim 6 further characterized by and including a non-skid coating on a portion of said lower platform.

8. The platform defice of claim 6 further characterized in that the bottom surface of said lower platform has means for positioning said lower platform upon a ladder rung.

9. The platform device of claim 8 further characterized in that said means for positioning the lower platform upon a ladder rung includes depressions in the bottom of said lower platform.

10. The platform device of claim 9 further characterized in that said means for positioning the lower platform upon a ladder rung includes a transversely extending curved area formed and adapted to rest upon a round ladder rung.

11. The platform device of claim 10 further characterized by and including a downwardly extending lip on an edge of said lower platform, with the spacing between said downwardly extending lip and the lower end of one of each pair of support members being such as to accomodate a non-round shaped ladder rung.

* * * * *